US011024459B2

(12) United States Patent
Murakami et al.

(10) Patent No.: US 11,024,459 B2
(45) Date of Patent: Jun. 1, 2021

(54) METHOD OF MANUFACTURING COIL COMPONENT

(71) Applicant: MURATA MANUFACTURING CO., LTD., Kyoto-fu (JP)

(72) Inventors: Takashi Murakami, Nagaokakyo (JP); Akio Igarashi, Nagaokakyo (JP); Koji Onishi, Nagaokakyo (JP)

(73) Assignee: MURATA MANUFACTURING CO., LTD., Kyoto-fu (JP)

( * ) Notice: Subject to any disclaimer, the term of this patent is extended or adjusted under 35 U.S.C. 154(b) by 307 days.

(21) Appl. No.: 15/716,145

(22) Filed: Sep. 26, 2017

(65) Prior Publication Data

US 2018/0096790 A1 Apr. 5, 2018

(30) Foreign Application Priority Data

Oct. 5, 2016 (JP) ..... JP2016-196821

(51) Int. Cl.
*H01F 41/10* (2006.01)
*H01F 27/28* (2006.01)
(Continued)

(52) U.S. Cl.
CPC ..... *H01F 41/10* (2013.01); *H01F 27/2828* (2013.01); *H01F 27/29* (2013.01); *H01F 41/076* (2016.01); *H01F 17/045* (2013.01)

(58) Field of Classification Search
CPC ..... H01F 17/045; H01F 27/29; H01F 27/292; H01F 2017/0093; H01F 27/2823;
(Continued)

(56) References Cited

U.S. PATENT DOCUMENTS

2008/0003864 A1* 1/2008 Hatakeyama ..... H01F 17/045 439/399
2015/0042434 A1* 2/2015 Bando ..... B65H 75/06 336/192

(Continued)

FOREIGN PATENT DOCUMENTS

CN 107887159 A 4/2018
JP S53-064788 A 6/1978

(Continued)

OTHER PUBLICATIONS

An Office Action; "Notification of Reasons for Refusal," Mailed by the Japanese Patent Office dated Jan. 8, 2019, which corresponds to Japanese Patent Application No. 2016-196821 and is related to U.S. Appl. No. 15/716,145; with English language translation.

*Primary Examiner* — Ibrahime A Abraham
*Assistant Examiner* — Chris Q Liu
(74) *Attorney, Agent, or Firm* — Studebaker & Brackett PC

(57) ABSTRACT

A method of manufacturing a coil component including a step of welding a wire to a metal terminal by laser welding capable of making positional displacement of the wire only minimally occur. As a metal terminal, a metal terminal having a connecting portion on which a positioning groove for receiving and positioning a portion of the wire is formed is prepared. The wire is temporarily fixed to the connecting portion in a state where the wire is positioned by being fitted in the positioning groove, and the wire and the metal terminal are welded to each other by irradiating a laser beam. The positioning groove is preferably formed into a V shape in cross section.

6 Claims, 9 Drawing Sheets

(51) Int. Cl.
*H01F 41/076* (2016.01)
*H01F 27/29* (2006.01)
*H01F 17/04* (2006.01)

(58) Field of Classification Search
CPC ..... H01F 41/10; H01F 17/04; H01F 27/245; H01F 27/306; H01F 41/02; H01F 41/0233; H01F 41/064; H01F 27/263; H01F 3/14; H01R 43/02
USPC ..... 219/121.6, 121.63, 121.64
See application file for complete search history.

(56) References Cited

U.S. PATENT DOCUMENTS

| | | | | |
|---|---|---|---|---|
| 2015/0042436 | A1* | 2/2015 | Arimitsu | H01F 17/045 336/192 |
| 2015/0116070 | A1* | 4/2015 | Arai | H01F 17/045 336/192 |
| 2016/0217919 | A1* | 7/2016 | Iwata | H01F 27/29 |
| 2016/0240305 | A1* | 8/2016 | Igarashi | H01F 27/2828 |
| 2018/0097327 | A1 | 4/2018 | Murakami et al. | |

FOREIGN PATENT DOCUMENTS

| | | | |
|---|---|---|---|
| JP | H10-064747 | A | 3/1998 |
| JP | H11-214113 | A | 8/1999 |
| JP | 2002-289453 | A | 10/2002 |
| JP | 2003-234218 | A | 8/2003 |
| JP | 4184394 | B2 | 11/2008 |
| JP | 2013-149893 | A | 8/2013 |
| JP | 2015-035473 | A | 2/2015 |
| JP | 2016-046331 | A | 4/2016 |
| WO | 2015/045955 | A1 | 4/2015 |

* cited by examiner

METHOD OF MANUFACTURING COIL COMPONENT

CROSS REFERENCE TO RELATED APPLICATIONS

This application claims benefit of priority to Japanese Patent Application 2016-196821 filed Oct. 5, 2016, the entire content of which is incorporated herein by reference.

TECHNICAL FIELD

The present disclosure relates to a method of manufacturing a coil component, and more particularly to a method of connecting a wire and a metal terminal to each other.

BACKGROUND

As a technique of interest related to the present disclosure, for example, there has been known a technique described in Japanese patent 4184394. FIG. 16 and FIG. 17 are drawings cited from Japanese patent 4184394, and correspond to FIG. 2 and FIG. 4 in Japanese patent 4184394, respectively. FIG. 9 and FIG. 10 show one flange portion 1 which forms a portion of a core provided to a coil component, a metal terminal 2 disposed on the flange portion 1, and an end portion of a wire 3 connected to the metal terminal 2.

As shown in FIG. 16 and FIG. 17, the wire 3 includes: a conductive wire portion 4 made of a conductor; and an insulating resin coating 5 which covers a peripheral surface of the conductive wire portion 4. The metal terminal 2 includes: a base portion 7 disposed on an outer end surface 6 side of the flange portion 1; and a receiving portion 9 extending from the base portion 7 by way of a bent portion 8 and receiving the end portion of the wire 3. The metal terminal 2 further includes: a welding portion 11 extending from the receiving portion 9 by way of a first folding portion 10 and welded to the conductive wire portion 4 of the wire 3; and a holding portion 13 extending from the receiving portion 9 by way of a second folding portion 12 and positioning the wire 3 by holding the wire 3.

With respect to the above-mentioned welding portion 11, a state of the welding portion 11 before a welding step is performed is shown in FIG. 16, and a state of the welding portion 11 after the welding step is performed is shown in FIG. 17. In FIG. 17, a melted ball 14 formed by welding is shown. The melted ball 14 is formed in such a manner that molten metal formed by welding is formed into a ball shape by surface tension, and the molten metal is solidified by being cooled while keeping a ball shape.

The detail of a step of connecting the wire 3 to the metal terminal 2 is described hereinafter. In a stage before such a connecting step is performed, in the metal terminal 2, the welding portion 11 and the holding portion 13 are in a state where the welding portion 11 and the holding portion 13 are opened with respect to the receiving portion 9 so that neither the welding portion 11 nor the holding portion 13 face the receiving portion 9. FIG. 16 shows a state where the welding portion 11 is opened with respect to the receiving portion 9 although the holding portion 13 faces the receiving portion 9.

Firstly, the wire 3 is placed on the receiving portion 9 of the metal terminal 2. To fix this state temporarily, the holding portion 13 is folded with respect to the receiving portion 9 by way of the second folding portion 12 such that the wire 3 is sandwiched between the receiving portion 9 and the holding portion 13.

Next, as shown in FIG. 16, a portion of the insulating resin coating 5 of the wire 3 disposed on a more distal end side than the holding portion 13 is removed. For example, a laser beam is irradiated to the insulating resin coating 5 for removing the insulating resin coating 5. As can be clearly understood from FIG. 16, a portion of the insulating resin coating 5 which is in contact with the receiving portion 9 is left without being removed.

Next, the welding portion 11 is folded with respect to the receiving portion 9 by way of the first folding portion 10 thus bringing about a state where the wire 3 is sandwiched between the welding portion 11 and the receiving portion 9.

Then, the conductive wire portion 4 of the wire 3 and the welding portion 11 are welded to each other. To be more specific, laser welding is applied. A laser beam is irradiated to the welding portion 11 so that the conductive wire portion 4 of the wire 3 and the welding portion 11 are melted to each other. A liquefied molten portion is formed into a ball shape by surface tension. Thereafter, the molten portion is solidified while keeping a ball shape so that the melt ball 14 is formed.

SUMMARY

In the technique described in Japanese patent 4184394, to temporarily fix the wire 3 before welding is performed, a state is brought about where the holding portion 13 faces the receiving portion 9 by bending the holding portion 13 by way of the second folding portion 12 thus bringing about a state where the wire 3 is sandwiched between the holding portion 13 and the receiving portion 9. However, in such a step, there is a possibility that the position of the wire 3 is displaced.

Further, in the above-mentioned temporary fixing step, after the state where the wire 3 is sandwiched between the holding portion 13 and the receiving portion 9 is brought about, a compression bonding step is performed so as to bring the holding portion 13 and the receiving portion 9 into close contact with each other. Also in this compression bonding step, there is a possibility that the position of the wire 3 is displaced.

The present disclosure has been made in view of such circumstances, and it is an object of the present disclosure to provide a method of manufacturing a coil component capable of making the above-mentioned positional displacement of a wire only minimally occur.

According to a first aspect of the present disclosure, there is provided a method of manufacturing a coil component which includes: a wire; and a metal terminal having a connecting portion which is electrically connected to an end portion of the wire.

To overcome the above-mentioned technical drawbacks, the method of manufacturing a coil component according to the present disclosure includes: preparing the metal terminal having the connecting portion on which a positioning groove for receiving and positioning a portion of the wire is formed; a positioning step of positioning the wire by fitting the wire in the positioning groove; a temporary fixing step of temporarily fixing the wire to the connecting portion; and a welding step of welding the wire and the metal terminal to each other by irradiating a laser beam.

In the present disclosure, the positioning groove formed on the connecting portion of the metal terminal functions so as to make undesired positional displacement of the wire difficult.

It is preferable that the wire include: a conductive wire portion made of a conductor and an insulating resin coating which covers a peripheral surface of the conductive wire portion, and the temporary fixing step include a thermocompression bonding step where the wire is adhered to the positioning groove using the melted insulating resin coating as an adhesive agent by applying heat and pressure to the wire positioned by being fitted in the positioning groove. By performing the temporary fixing step in this manner, the wire can be temporarily fixed by making use of the insulating resin coating which the wire includes as an adhesive agent.

In the above-mentioned preferred mode of the present disclosure, it is preferable that the metal terminal which includes a receiving portion on which a positioning groove is formed and a contact portion extending from the receiving portion via a bending scheduled portion in the connecting portion, the temporary fixing step further includes a contacting step where, after the above-mentioned thermocompression bonding step is finished, the connecting portion is bent via the bending scheduled portion such that the contact portion faces the receiving portion with the wire interposed therebetween and is brought into contact with the wire, and a laser beam be irradiated to the contact portion in the welding step. With such a configuration, the contact portion can perform temporary fixing of the wire with more certainty.

In the above-mentioned preferred mode of the present disclosure, a direction that the positioning groove extends and a direction that the bending scheduled portion extends are parallel to each other, and the positioning groove and the bending scheduled portion be not located on the same line. With such a configuration, bending at the bending scheduled portion does not overlap with the positioning groove and hence, positioning of the wire fitted in the positioning groove becomes stable.

In the above-mentioned temporary fixing step, in place of the thermocompression bonding step or in addition to the thermocompression bonding step, it may be possible to perform a step of preparing a pressing segment where the pressing segment and the connecting portion sandwich the wire positioned by being fitted in the positioning groove, and a step of fixing the wire by pressing the wire toward the connecting portion by the pressing segment. The pressing segment is disposed on a manufacturing facility side so that it is unnecessary to provide the previously mentioned contact portion to the metal terminal. When the contact portion is not provided to the metal terminal, the shape of the metal terminal can be further simplified.

It is preferable that the positioning groove be formed in a V shape in cross section. By forming the positioning groove in a V shape in cross section, it is possible to perform positioning of the wire with high accuracy with respect to a direction orthogonal to the direction that the positioning groove extends.

It is preferable that the positioning groove be located within a region where welding is scheduled in the welding step. With such a configuration, it is possible to acquire a state where the positioning groove does not remain after the welding step is finished.

According to the present disclosure, positioning displacement of the wire is minimally generated due to the formation of the positioning groove and hence, welding of the connecting portion of the metal terminal and the wire can be performed with a proper positional relationship. Accordingly, it is possible to prevent the occurrence of a connection defect of the wire or a defect of appearance of a product which may be caused when the positional displacement of the wire is generated as much as possible.

BRIEF DESCRIPTION OF THE DRAWINGS

FIG. 16 is a perspective view showing a flange portion 1 of a core provided to a coil component disclosed in Japanese patent 4184394, a metal terminal 2 disposed on the flange portion 1, and a wire 3 connected to the metal terminal 2, wherein FIG. 16 shows a state of these portions before a welding step is performed.

DETAILED DESCRIPTION

Figure 1:
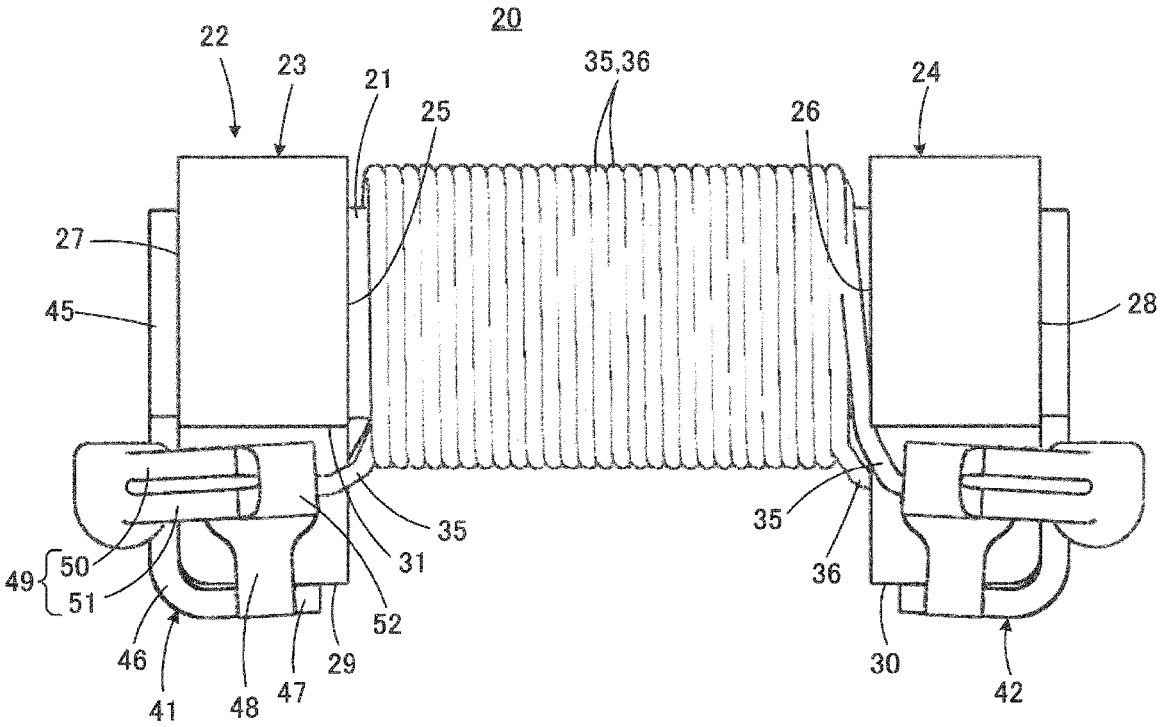
FIG. 1 is a front view showing an external appearance of one example of a coil component manufactured by a manufacturing method according to the present disclosure.
Figure 2:
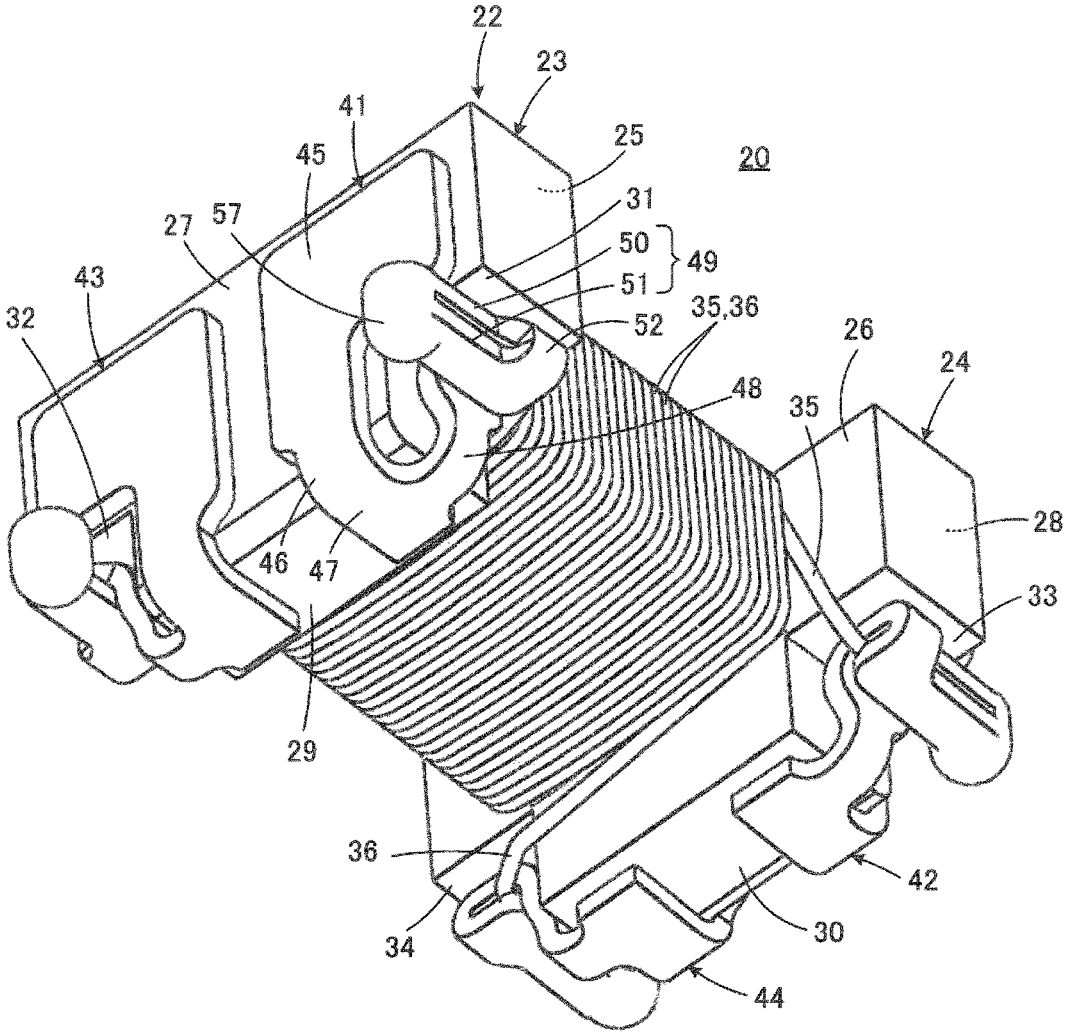
FIG. 2 is a perspective view showing a coil component 20 shown in FIG. 1 as viewed from a bottom surface side.
Figure 3:
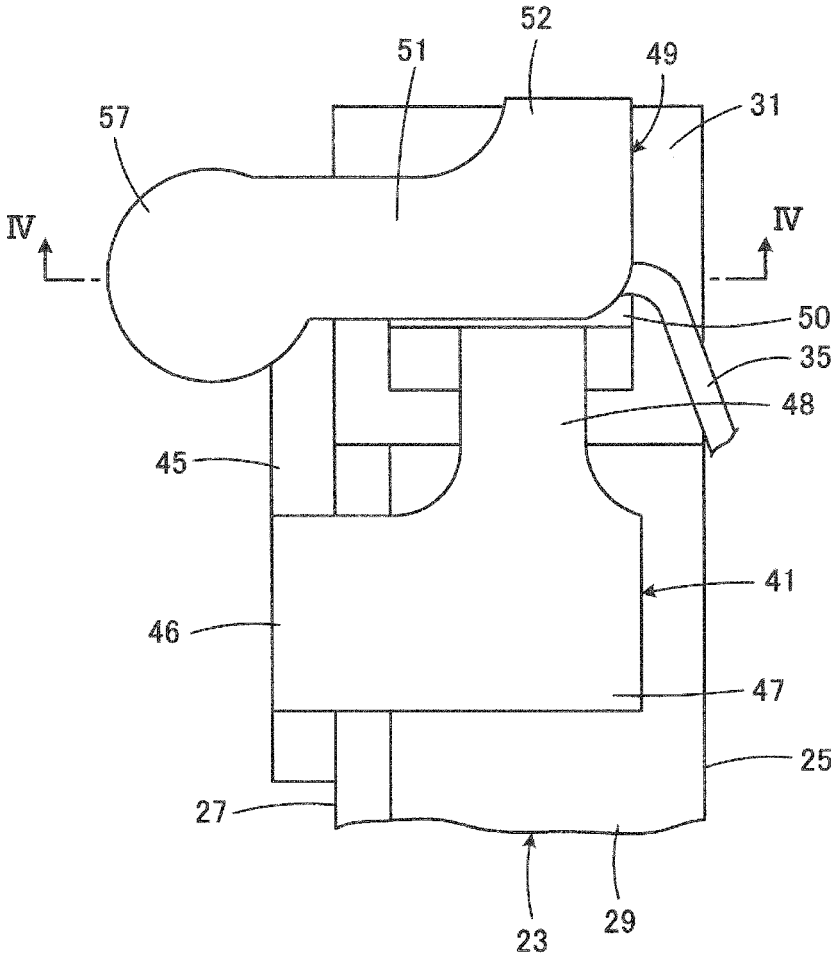
FIG. 3 is a bottom surface view showing a portion of the coil component 20 shown in FIG. 1 and FIG. 2, wherein a metal terminal 41, a portion of a flange portion 23 of a core on which the metal terminal 41 is disposed, and a wire 35 which is connected to the metal terminal 41 are shown.

The structure of a coil component 20 which is manufactured by a manufacturing method according to the present disclosure is described mainly with reference to FIG. 1 and FIG. 2. To be more specific, the coil component 20 shown in FIG. 1 and FIG. 2 forms a common mode choke coil as one example of a coil component.

The coil component 20 includes a core 22 having a winding core portion 21. The core 22 has a drum shape, and includes a first flange portion 23 and a second flange portion 24 which are formed on end portions of the winding core portion 21 respectively. The core 22 is made of a magnetic material such as ferrite, for example.

The flange portions 23, 24 respectively have: an inner end surface 25, 26 which faces a winding core portion 21 side and at which each end portion of the winding core portion 21 is positioned; and an outer end surface 27, 28 which faces the outside on a side opposite to the inner end surface 25, 26. Further, the flange portions 23, 24 respectively have a bottom surface 29, 30 which faces a printed circuit board (not shown in the drawing) side when the coil component 20 is actually mounted.

Recesses 31, 32 each having a cutout shape are formed on both end portions of the bottom surface 29 of the first flange portion 23 respectively. In the same manner, recesses 33, 34 each having a cutout shape are formed on both end portions of the bottom surface 30 of the second flange portion 24 respectively.

Figure 9:
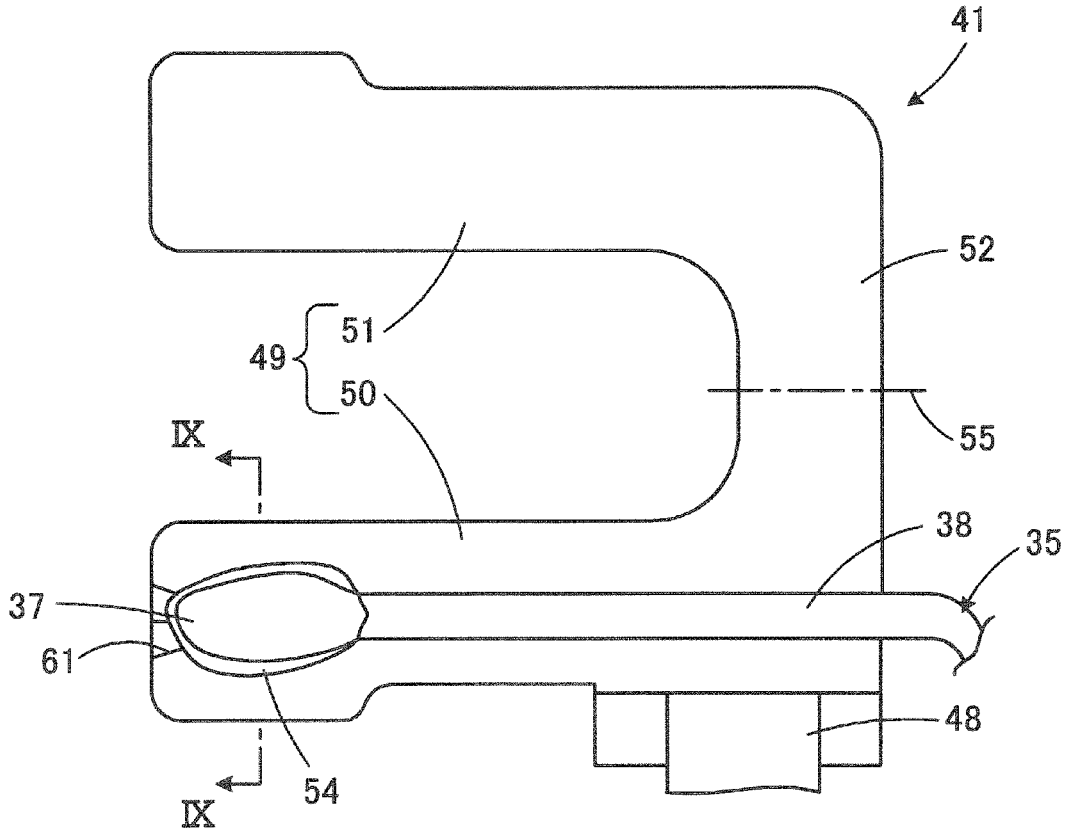
FIG. 9 is a plan view showing a state where the wire 35 is temporarily fixed onto the connecting portion 49 of the metal terminal 41 after the step shown in FIG. 7 is finished.
Figure 10:
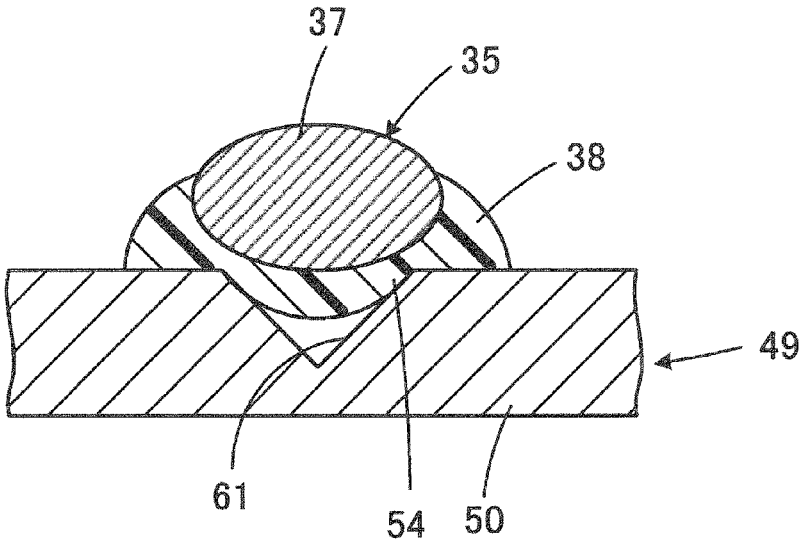
FIG. 10 is a cross-sectional view taken along line IX-IX in FIG. 9.

The coil component 20 further includes first and second wires 35, 36 which are spirally wound around the winding core portion 21. As shown in FIG. 9 and FIG. 10 described later, each of the wires 35, 36 has: a conductive wire portion 37 made of a conductor; and an insulating resin coating 38 which covers a periphery of the conducive wire portion 37. The conductive wire portion 37 is formed of a copper wire, for example. The insulating resin coating 38 is made of a resin such as polyurethane, polyimide, polyesterimide or polyamideimide, for example.

When the coil component 20 is a common mode choke coil, the wires 35, 36 are wound in the same direction. In this case, the wires 35, 36 may be wound in a double-layered manner such that either one of the wires is wound on an inner layer side, and the other wire is wound on an outer layer side, or may be wound by bifilar winding such that the wires are disposed alternately and parallel to each other in an axial direction of the winding core portion 21.

The coil component 20 further includes first to fourth metal terminals 41 to 44. Out of these first to fourth metal terminals 41 to 44, the first and third metal terminals 41, 43 are fixed to the first flange portion 23 by way of an adhesive agent. The second and fourth metal terminals 42, 44 are fixed to the second flange portion 24 by way of an adhesive agent.

The first metal terminal 41 and the fourth metal terminal 44 have the same shape, and the second metal terminal 42 and the third metal terminal 43 have the same shape. The first metal terminal 41 and the third metal terminal 43 have shapes which are in plane symmetry with each other, and the second metal terminal 42 and the fourth metal terminal 44 have shapes which are in plane symmetry with each other. Accordingly, the detailed description is made with respect to one of first to fourth metal terminals 41 to 44, for example, the first metal terminal 41, and the detailed description of the second, third and fourth metal terminals 42, 43 and 44 is omitted.

In FIG. 3 to FIG. 11, the metal terminal 41 or a portion of the metal terminal 41 is shown.

Usually, the metal terminal 41 is manufactured by applying sheet metal working to one metal sheet made of a copper-based alloy such as phosphor bronze or tough pitch copper, for example. However, the metal terminal 41 may be manufactured by other manufacturing methods such as casting, for example.

The metal terminal 41 includes: a base portion 45 extending along the outer end surface 27 of the flange portion 23; and a mounting portion 47 extending from the base portion 45 along the bottom surface 29 of the flange portion 23 by way of a first bent portion 46 which covers a ridge portion of the flange portion 23 where the outer end surface 27 and the bottom surface intersect with each other. When the coil component 20 is mounted on a printed circuit board not shown in the drawing, the mounting portion 47 forms a portion which is electrically and mechanically connected to a conductive land on the printed circuit board by soldering or the like.

The metal terminal 41 includes a connecting portion 49 extending from the mounting portion 47 by way of a second bent portion 48. Due to the formation of the second bent portion 48, the metal terminal 41 has an S-shaped bent shape. The connecting portion 49 has both a function of positioning the wire 35 by receiving the wire 35 and a function of electrically and mechanically connecting the wire 35 to the metal terminal 41.

To be more specific, the connecting portion 49 includes: a receiving portion 50 which receives the wire 35; and a contact lug 51 which extends by way of a joint portion 52 folded from the receiving portion 50 so as to overlap with the receiving portion 50 and is brought into contact with the wire 35 so as to position the wire 35 between the contact lug 51 and the receiving portion 50. The connecting portion 49 is positioned in the recess 31 formed on the first flange portion 23.

A positioning groove 61 for receiving and positioning a portion of the wire 35 is formed on a receiving portion 50 side of the connecting portion 49. The positioning groove 61 is shown in FIG. 5 to FIG. 10. The positioning groove 61 extends toward the inside from a distal end of the receiving portion 50 of the connecting portion 49. The positioning groove 61 defines a space having a triangular pyramid shape. As clearly shown in FIG. 6, the closer the positioning groove 61 to the distal end of the receiving portion 50, the deeper a depth of the positioning groove 61 becomes, while as clearly shown in FIG. 5, the closer the positioning groove 61 to the distal end of the receiving portion 50, the wider a width of the positioning groove 61 becomes. The positioning groove 61 has an isosceles triangular planar shape as clearly shown in FIG. 5, and has a V-shaped cross section as clearly shown in FIG. 10.

The depth and the width of the positioning groove 61 can be arbitrarily set provided that the positioning groove 61 can perform a function of receiving and positioning a portion of the wire 35 in the positioning groove 61. For example, it is preferable to set the depth and the width of the positioning groove 61 such that a portion of the wire 35 having the sizes which are ⅓ to ½ inclusive of a diameter of the wire 35 can be received in the positioning groove 61 at a deepest and widest portion of the positioning groove 61.

Figure 8:
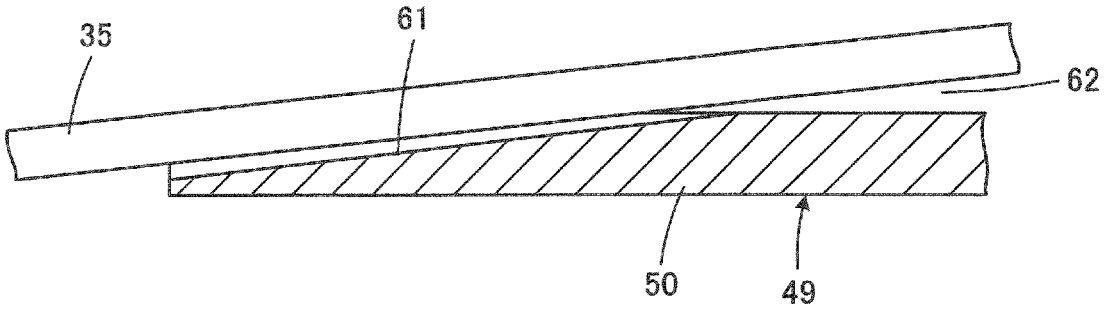
FIG. 8 is a cross-sectional view taken along line VIII-VIII in FIG. 7.

It is unnecessary to form the positioning groove 61 over the whole length of the receiving portion 50 of the connecting portion 49. That is, it is unnecessary to form the positioning groove 61 such that the positioning groove 61 traverses the receiving portion 50 in the longitudinal direction. The positioning groove 61 is formed only in a limited region of a distal end portion of the receiving portion 50 of the connecting portion 49. Further, as described previously, the positioning groove 61 defines a space having a triangular pyramid shape. Accordingly, when the wire 35 pulled out from a wire nozzle (not shown in the drawing) is received in the positioning groove 61, as shown in FIG. 8, the wire 35 is inclined with respect to an extending surface of the receiving portion 50 so that a gap 62 is formed on a proximal end side of the receiving portion 50.

In this embodiment, as clearly shown in FIG. 10, the positioning groove 61 is formed by applying coining which decreases a thickness of a portion of the metal sheet to a metal sheet used for forming the metal terminal 41. However, the positioning groove 61 may be formed by applying embossing where a portion of the metal sheet is extruded while maintaining a thickness of the metal sheet to a substantially fixed thickness.

The reference symbols 45, 46, 47, 48, 49, 50, 51, 52 and 61 which are used for indicating the base portion, the first bent portion, the mounting portion, the second bent portion, the connecting portion, the receiving portion, the contact lug, the joint portion, and the positioning groove in the previously described first metal terminal 41 may be also used for indicating the corresponding base portions, the corresponding first bent portions, the corresponding mounting portions, the corresponding second bent portions, the corresponding connecting portions, the corresponding receiving portions, the corresponding contact lugs, the corresponding joint portions, and corresponding positioning grooves in the second, third and fourth metal terminals 42, 43 and 44.

There may be a case where the reference symbols 45, 46, 47, 48, 49, 50, 51 and 52 used for indicating the base portion, the first bent portion, the mounting portion, the second bent portion, the connecting portion, the receiving portion, the contact lug and the joint portion of the above-mentioned first metal terminal 41 respectively are also used for indicating the base portions, the first bent portions, the mounting portions, the second bent portions, the connecting portions, the receiving portions, the contact lugs, and the joint portions of the second, third and fourth metal terminals 42, 43 and 44 which correspond to the above-mentioned portions of the first metal terminal 41.

Figure 5:
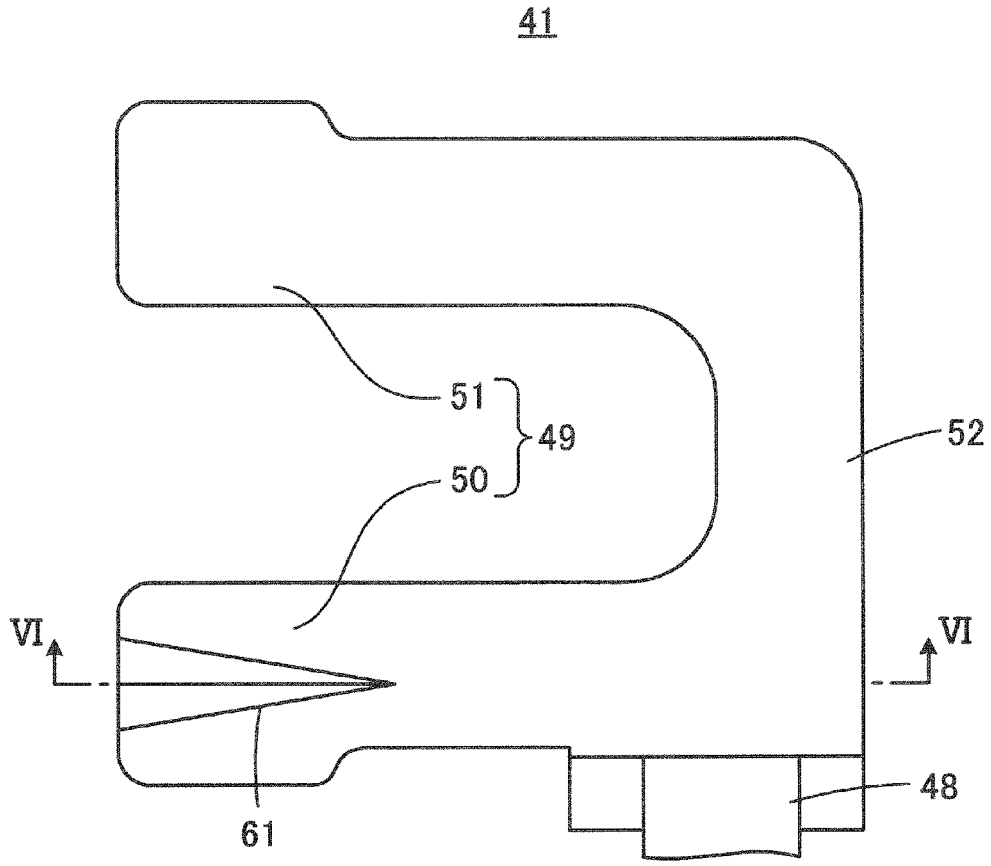
FIG. 5 is a plan view for describing a manufacturing method according to a first embodiment of the present disclosure, particularly, a connecting step of connecting the metal terminal and the wire 35 shown in FIG. 3 to each other, wherein a developed state of the metal terminal 41 before the metal terminal 41 is bent is shown.
Figure 6:
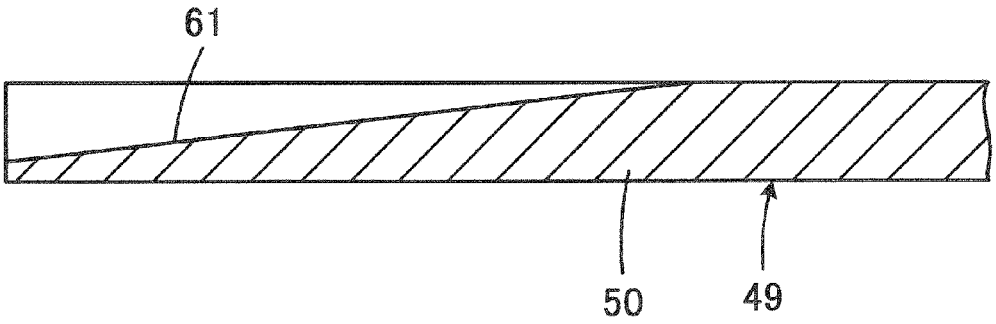
FIG. 6 is a cross-sectional view taken along line VI-VI in FIG. 5.
Figure 7:
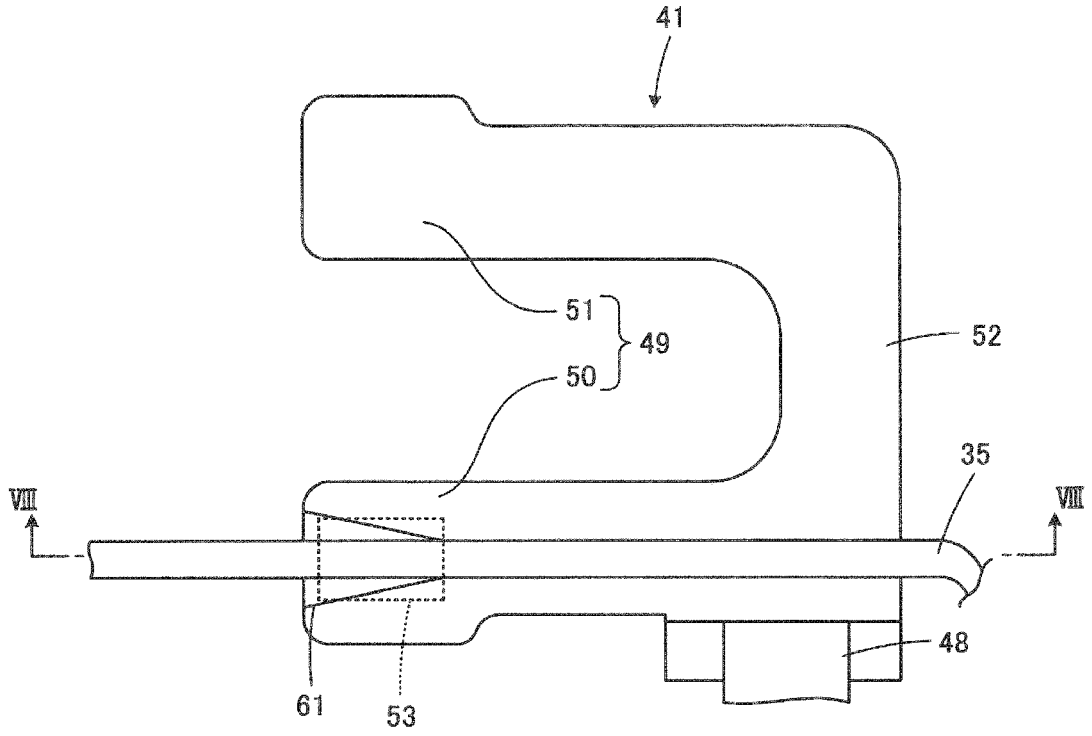
FIG. 7 is a plan view showing a state where the wire 35 is positioned on a connecting portion 49 of the metal terminal 41 shown in FIG. 5.

In a stage before the wire 35 is connected to the first metal terminal 41, as shown in FIG. 5, the metal terminal 41 is in a state where the contact lug 51 is developed with respect to the receiving portion 50 in the connecting portion 49. In such a state, an end portion of the wire 35 which is wound around the winding core portion 21 is pulled out onto the receiving portion 50 of the connecting portion 49 of the metal terminal 41 by a wire nozzle, and is positioned on the receiving portion 50 of the connecting portion 49. In this case, as shown in FIG. 7 and FIG. 8, the wire 35 is positioned such that the wire 35 is fitted in the positioning groove 61.

Next, the wire 35 is temporarily fixed to the receiving portion 50 of the connecting portion 49. For this temporary fixing, the thermocompression bonding step is performed where heat and pressure are applied to the wire 35 in a state where the wire 35 is placed on the receiving portion 50. In the thermocompression bonding step, for example, a heater chip 53 which heats a region indicated by a dotted line in FIG. 7 is used. When the wire 35 on the receiving portion 50 of the connecting portion 49 is pressed while being heated by the heater chip 53, the insulating resin coating 38 is melted or softened. As a result, as shown in FIG. 9 and FIG. 10, a melted/softened material 54 derived from the insulating resin coating 38 functions as an adhesive agent so that the wire 35 is adhered to the positioning groove 61 on the receiving portion 50 by way of the melted/softened material 54. At this stage of operation, as a result of pressurizing in the thermocompression bonding step, the conductive wire portion 37 of the wire 35 is generally formed into a flat shape in cross section as shown in FIG. 10.

In the temporary fixing step, a place where the wire 35 is adhered may not always be the positioning groove 61. The wire 35 may be adhered to an area in the vicinity of the positioning groove 61 on the receiving portion 50.

It is preferable that, as a result of the above-mentioned thermocompression bonding step, as shown in FIG. 10 clearly, the conductive wire portion 37 be brought into a state where a portion of the insulating resin coating 38 positioned on a side opposite to a receiving portion 50 side is removed so that the conductive wire portion 37 is exposed from the insulating resin coating 38. To acquire such a state where the conductive wire portion 37 is exposed from the insulating resin coating 38 in the thermocompression bonding step, for example, the thermocompression bonding step is performed under the following conditions.

First, as the heater chip 53, a heater chip having an area sufficient to cover the wire 35 and the receiving portion 50 of the connecting portion 49 is used, and a contact surface of the heater chip 53 is a planar surface having a smooth surface. When the insulating resin coating 38 is made of polyamideimide, a temperature which falls within a range of from 400° C. to 550° C. inclusive is adopted as a thermocompression bonding temperature, and a thermocompression bonding time is set to 2 seconds or less. In this case, the insulating resin coating 38 is removed only at a portion where the heater chip 53 is brought into contact with the insulating resin coating 38. On the other hand, at portions of the insulating resin coating 38 where the heater chip 53 and the insulating resin coating 38 are not brought into contact with each other, melting of the insulating resin coating 38 due to the heat conduction is not completed so that the insulating resin coating 38 contributes to bonding between the wire 35 and the receiving portion 50 of the connecting portion 49 in a state where the insulating resin coating 38 remains in an incomplete melted state.

When the exposure of the conductive wire portion 37 from the insulating resin coating 38 is insufficient, the insulating resin coating 38 may be removed by irradiation of a laser beam, for example. The exposure of the conductive wire portion 37 from the insulating resin coating 38 is not always necessary, and succeeding steps may be performed in a state where the exposure of the conductive wire portion 37 from the insulating resin coating 38 is insufficient or in a state where there is no exposure of the conductive wire portion 37 from the insulating resin coating 38.

A portion of the wire 35 projecting from the receiving portion 50 of the connecting portion 49 is removed by cutting simultaneously with the above-mentioned thermocompression bonding step.

Figure 11:
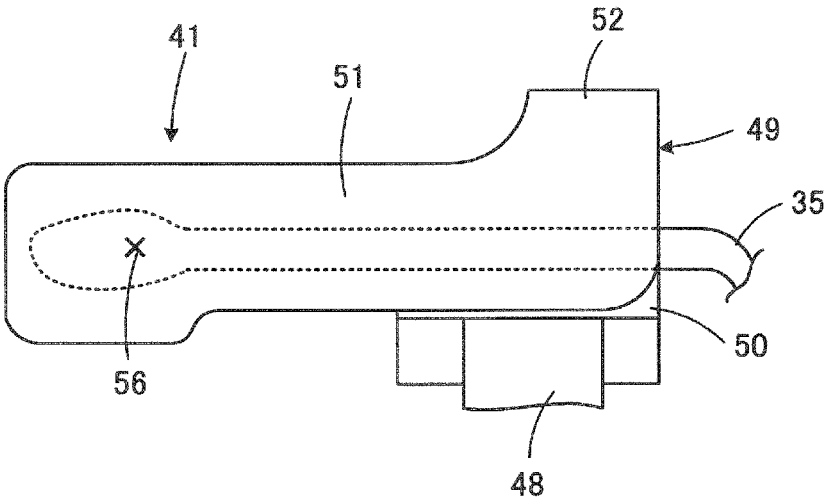
FIG. 11 is a plan view showing a state where, after the step shown in FIG. 9 is finished, the connecting portion 49 is bent such that a contact lug 51 overlaps with a receiving portion 50, and the wire 35 is sandwiched between the receiving portion 50 and the contact lug 51.

Next, a contacting step is performed where the joint portion 52 is bent at a bending scheduled portion 55 indicated by a dotted chain line in FIG. 9. Due to such bending in the contacting step, as shown in FIG. 11, the contact lug 51 is brought into contact with the wire 35 and, at the same time, the contact lug 51 is made to overlap with the receiving portion 50 in a state where the contact lug 51 faces the receiving portion 50 with the wire 35 sandwiched therebetween. When the contact lug 51 is brought into contact with the wire 35, it is preferable that the contact lug 51 be brought into contact with the conductive wire portion 37 exposed from the insulating resin coating 38.

In the above-mentioned contacting step, in a state where a portion of the metal terminal 41 ranging from the base portion 45 to the mounting portion 47 is fixed, the contact lug 51 of the connecting portion 49 in a state shown in FIG. 9 is pushed up by a tool from a back side to a front side of a paper surface on which FIG. 9 is drawn so that, firstly, the metal terminal 41 is brought into a state where the contact lug 51 is bent by 90 degrees about the bending scheduled portion 55. Next, the tool is brought into contact with and is pressed to the contact lug 51 from a lateral side so that the contact lug 51 is bent at 90 degrees thus further bending the contact lug 51 by 90 degrees about the bending scheduled portion 55. With such operations, a state shown in FIG. 11 is obtained so that the contact lug 51 and the wire 35 are brought into contact with each other.

In this embodiment, although a direction that the positioning groove 61 extends and a direction that the bending scheduled portion 55 extends are parallel to each other, the positioning groove 61 and the bending scheduled portion 55 are not positioned on the same line. With such a configuration, bending at the bending scheduled portion 55 does not overlap with the positioning groove 61 and hence, positioning of the wire fitted in the positioning groove 61 becomes stable.

The positioning groove 61 is not formed to extend in the bending direction of the bending scheduled portion 55 over the whole width of the bending scheduled portion 55. With such a configuration, it is possible to prevent the metal terminal 41 from being erroneously bent at the position of the positioning groove 61 at the time of bending the metal terminal 41 so that the metal terminal 41 can be bent at the bending scheduled portion 55 with certainly.

After the contact lug 51 and the wire 35 are brought into contact with each other as described above, preferably, a caulking step is performed so as to bring the receiving portion 50 and the contact lug 51 into close contact with each other. In the caulking step, it is preferable that the receiving portion 50 and the contact lug 51 be bonded to each other by pressure bonding in a state where a heater heated to 500° C., for example, is brought into pressure contact with the contact lug 51, and the wire 35 is sandwiched between the receiving portion 50 and the contact lug 51. According to this caulking step, it is possible to bring a close contact state between the contact lug 51 and the wire 35 with certainty against a spring back phenomenon which is liable to occur at the time of bending the connecting portion 49 of the metal terminal 41. Further, the formation of gaps between the wire 35, the receiving portion 50 and the contact lug 51 can be substantially eliminated.

Next, a welding step is performed. In the welding step, it is preferable that a laser beam be irradiated to a surface of the contact lug 51 on a side opposite to a surface of the contact lug 51 which is adhered to the wire 35. In FIG. 11, a laser beam irradiation position 56 is shown. As one example, a laser beam having a wavelength of 1064 nm is irradiated for several milliseconds to a portion of the contact lug 51 displaced inward by 0.1 mm from a distal end of the contact lug 51.

Figure 4:
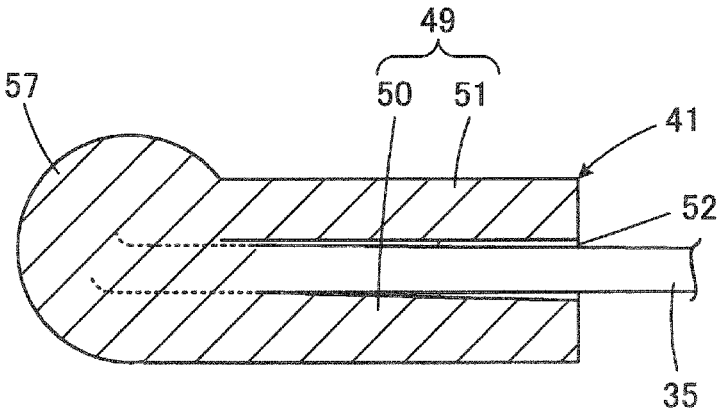
FIG. 4 is a cross-sectional view of the metal terminal 41 taken along line IV-IV in FIG. 3.

In the above-mentioned laser welding step, as shown in FIG. 4, the receiving portion 50 and the contact lug 51 are integrally formed with each other by way of a melted ball 57 at a position different from the joint portion 52. The melted ball 57 is formed by laser welding. In this embodiment, the receiving portion 50 and the contact lug 51 are integrally formed with each other by way of the melted ball 57 at respective distal end portions of the receiving portion 50 and the contact lug 51. Further, as shown in FIG. 4, it is possible to bring about a state where the whole periphery of the end portion of the wire 35 is covered by the melted ball 57. That is, the end portion of the wire 35 is positioned in the melted ball 57. The wire 35 has a small thickness at a boundary portion between a portion deformed by thermocompression bonding and a non-deformed portion so that the wire 35 is liable to be easily broken at the boundary portion. In view of the above, it is preferable that the whole portion of the wire 35 deformed by thermocompression bonding be enclosed in the melted ball 57. With such a configuration, the wire 35 has no thin portion so that the wire 35 is minimally broken.

In this embodiment, the above-mentioned positioning groove 61 is positioned within a region where welding is scheduled in the welding step. With such a configuration, it is possible to acquire a state where the positioning groove 61 does not remain after the welding step is finished.

The receiving portion 50 and the contact portion 51 of the metal terminal 41 are respectively formed such that a width on a proximal side is narrower than a width of a distal end portion. By adopting such a shape, it is possible to make the temperature elevation brought about by the welding step only minimally transferred to a core 22 side.

In the above-mentioned welding step, a laser beam may be irradiated to a portion of the contact lug 51 other than the surface of the contact lug 51 on a side opposite to the surface of the contact lug 51 which is adhered to the wire 35. For example, a laser beam may be irradiated to a surface of the receiving portion 50 which is adhered to the wire 35.

Although the description has been made with respect to the connection between the first metal terminal 41 and the first wire 35, substantially the same steps are performed also with respect to the connections between other metal terminals 42 to 44 and the wire 35 or 36 so that the coil component 20 shown in FIG. 1 and FIG. 2 is completed.

Figure 12:
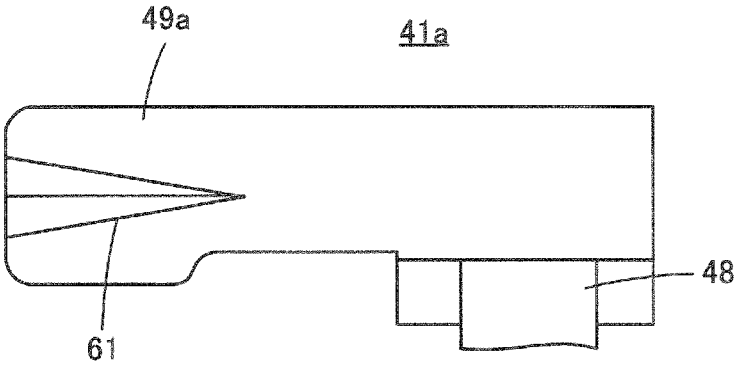
FIG. 12 is a plan view for describing a manufacturing method according to a second embodiment of the present disclosure, particularly, a connecting step of connecting a metal terminal 41*a* and a wire 35 to each other, wherein the metal terminal 41*a* is shown.

Next, a second embodiment of the present disclosure is described with reference to FIG. 12 to FIG. 15. The second embodiment is characterized in that a contact portion is not formed on a connecting portion of a metal terminal compared to the first embodiment. FIG. 12 corresponds to FIG. 5, FIG. 13 corresponds to FIG. 7, FIG. 14 corresponds to FIG. 9, and FIG. 15 partially corresponds to FIG. 3. In FIG. 12 to FIG. 15, constitutional elements corresponding to the constitutional elements shown in FIG. 5, FIG. 7, FIG. 9 and FIG. 3 are given the same symbols, and the repeated description of these constitutional elements is omitted.

Also in the second embodiment, the description is made with respect to a first metal terminal 41*a*. In FIG. 12, a portion of a second bent portion 48 which the metal terminal 41*a* includes is shown. The metal terminal 41*a* of the second embodiment also includes the configuration of the metal terminal 41 of the first embodiment ranging from the base portion 45 to the second bent portion 48.

A connecting portion 49*a* of the metal terminal 41*a* includes only a portion corresponding to the receiving portion 50 in the first embodiment. A positioning groove 61 is formed on the connecting portion 49*a*. The positioning groove 61 has substantially the same shape as the positioning groove 61 of the first embodiment, and is formed at substantially the same position as the positioning groove 61 of the first embodiment.

Figure 13:
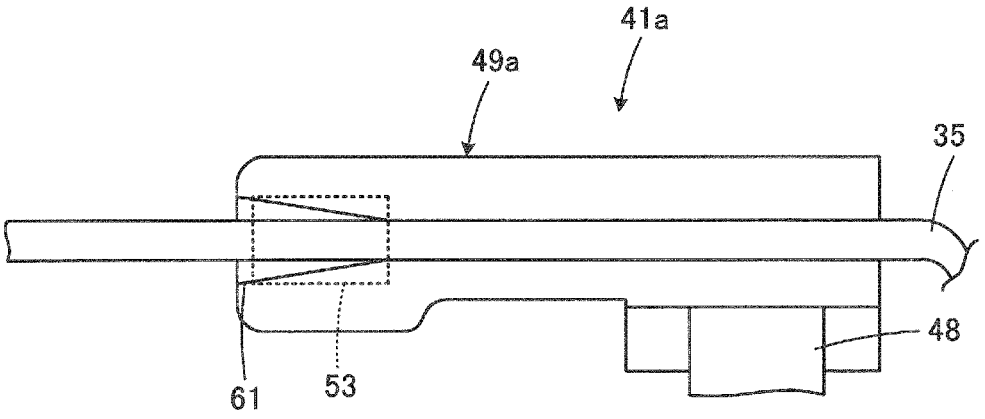
FIG. 13 is a plan view showing a state where the wire is positioned on a connecting portion 49*a* of the metal terminal 41*a* shown in FIG. 12.

As shown in FIG. 13, an end portion of a wire 35 wound around a winding core portion is pulled out onto the connecting portion 49*a* of the metal terminal 41*a* by a wire nozzle, and is positioned on the connecting portion 49*a*. In such a state, the wire 35 is positioned such that the wire 35 is fitted in the positioning groove 61.

Next, the wire 35 is temporarily fixed to the connecting portion 49*a*. For this temporary fixing, a thermocompression bonding step is performed in the same manner as in the case in the first embodiment. In FIG. 13, a region to be heated by a heater chip 53 is shown by a dotted line. When the wire 35 on the connecting portion 49*a* is pressed while being heated by the heater chip 53, the insulating resin coating 38 is melted or softened. As a result, as shown in FIG. 14, a melted/softened material 54 derived from the insulating resin coating 38 functions as an adhesive agent so that the wire 35 is adhered to the connecting portion 49*a* by way of the melted/softened material 54.

A portion of the wire 35 projecting from the connecting portion 49*a* is removed by cutting simultaneously with the above-mentioned thermocompression bonding step.

Figure 14:
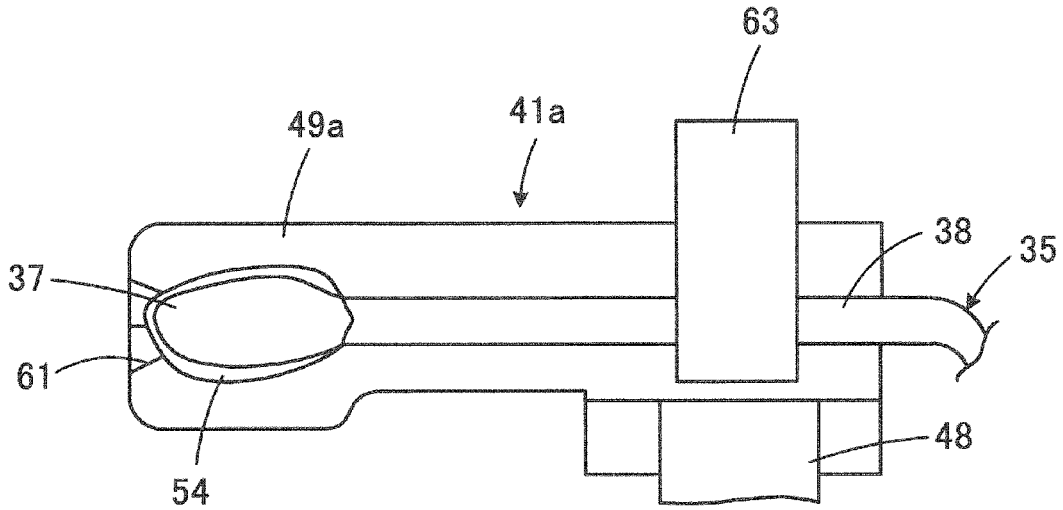
FIG. 14 is a plan view showing a state where, after the step shown in FIG. 13 is finished, the wire 35 is temporarily fixed onto the connecting portion 49*a* of the metal terminal 41*a*, and a state where the wire 35 is pressed toward the connecting portion 49*a* by a pressing segment 63.

In FIG. 14, a pressing segment 63 is shown. The pressing segment 63 is disposed on a manufacturing facility side, and is provided for fixing the wire 35 by pressing the wire 35 toward the connecting portion 49*a*. Preferably, the pressing segment 63 has a spring property and is resiliently brought into contact with the wire 35. The following welding step is performed in a state where the pressing segment 63 presses the wire 35.

A state where the pressing segment 63 presses the wire 35 may be taken at a stage where the above-mentioned temporary fixing step is performed. In this case, temporary fixing may be realized only by pressing the wire 35 by the pressing segment 63 without performing the thermocompression bonding step in the temporary fixing step.

Figure 15:
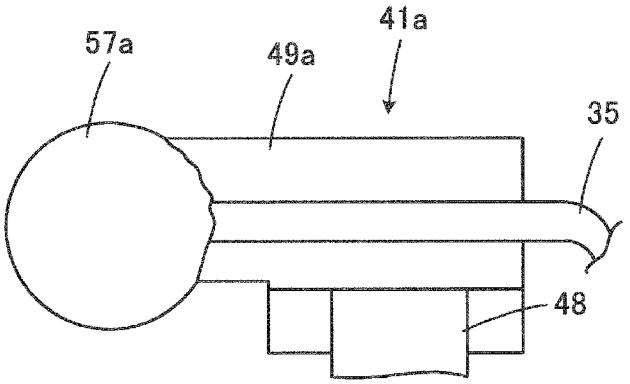
FIG. 15 is a plan view showing a state where the wire 35 and the metal terminal 41*a* are welded to each other after the step shown in FIG. 14 is finished.
Figure 16:
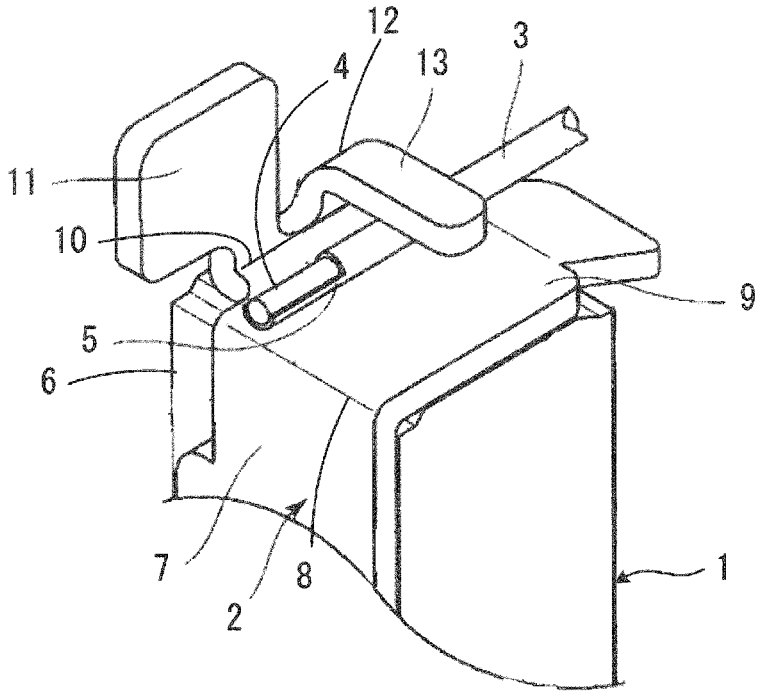
Figure 17:
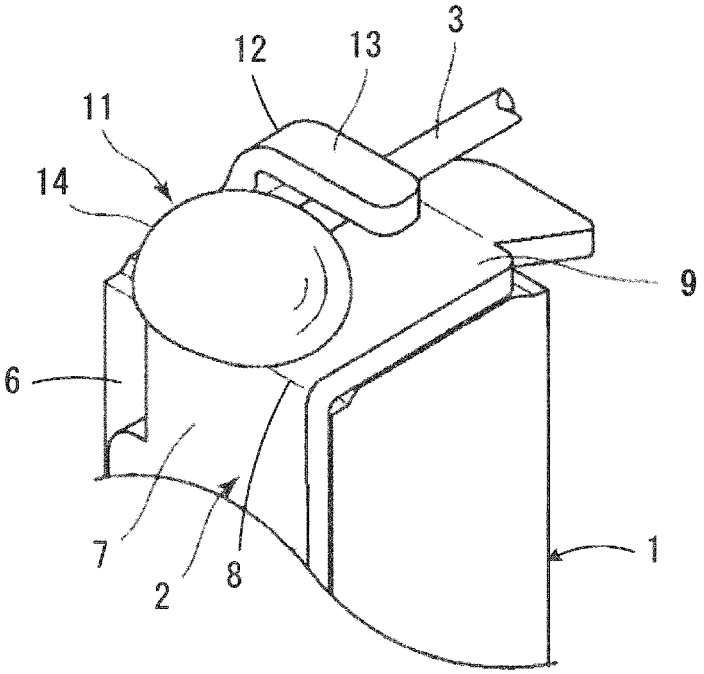
FIG. 17 is a perspective view showing a state of the portions shown in FIG. 16 after the welding step is performed.

Next, the welding step is performed. In the welding step, a laser beam is irradiated to a portion of the connecting portion 49*a* which is adhered to the wire 35. In FIG. 15, a melted ball 57*a* generated after welding is performed is shown. The melted ball 57*a* is formed in such a manner that a conductive wire portion 37 of the wire 35 and the connecting portion 49*a* are melted to each other, and a liquefied melted portion is formed into a ball shape by surface tension and, thereafter, the melted portion is solidified by being cooled while keeping a ball shape.

Also in the second embodiment, the positioning groove 61 is positioned within a region where welding is scheduled in the welding step. Accordingly, the positioning groove 61 does not remain after the welding step is finished.

In the second embodiment, the description has been made with respect to the connection between the first metal terminal 41*a* and the first wire 35. However, substantially the same steps are performed also with respect to the connections between other metal terminals and the wire.

Although the description has been made with respect to the coil component manufactured by the manufacturing method of the present disclosure based on the specific embodiment, the embodiment is merely described exemplarily, and various other modifications are conceivable.

For example, although not shown in FIG. 1 and FIG. 2, a plate-like core which extends between a pair of first and second flange portions 23, 24 may be provided in a state where a main surface of the core on one side is brought into contact with respective ceiling surfaces of the first and second flange portions 23, 24. In this case, when both a drum-shaped core 22 and the plate-like core are made of a magnetic material such as ferrite, a closed magnetic circuit is formed by the drum-shaped core 22 and the plate-like core.

The drum-shaped core 22 may be made of a non-magnetic material such as a resin, for example.

A coil component which is manufactured by the manufacturing method of the present disclosure may be a coil component having no core.

The number of wires which the coil component has and the number of metal terminals which the coil component has may be changed corresponding to a function of the coil component.

Although the present disclosure has been described with reference to the first embodiment and the second embodiment, the configuration of one embodiment may be partially replaced with the configuration of the other embodiment, or the configuration of one embodiment and the configuration of the other embodiment may be combined with each other.

What is claimed is:

1. A method of manufacturing a coil component which includes: a wire; and a metal terminal having a connecting portion which is electrically connected to an end portion of the wire, the method comprising:

preparing the metal terminal having the connecting portion on which a positioning groove for receiving and positioning a portion of the wire is formed;

positioning the wire by fitting the wire in the positioning groove;

temporarily fixing the wire to the connecting portion; and welding the wire and the metal terminal to each other by irradiating a laser beam, wherein the wire includes: a conductive wire portion made of a conductor and an insulating resin coating which covers a peripheral surface of the conductive wire portion, and the temporary fixing includes a thermocompression bonding where the wire is adhered to the positioning groove using the melted insulating resin coating as an adhesive agent by applying heat and pressure to the wire positioned by being fitted in the positioning groove.

2. The method of manufacturing a coil component according to claim 1, wherein the metal terminal includes a receiving portion on which the positioning groove is formed and a contact portion extending from the receiving portion via a bending scheduled portion in the connecting portion, the temporary fixing further includes a contacting step where, after the thermocompression bonding is finished, the connecting portion is bent via the bending scheduled portion such that the contact portion faces the receiving portion with the wire interposed therebetween and is brought into contact with the wire, and the welding includes irradiating a laser beam to the contact portion.

3. The method of manufacturing a coil component according to claim 2, wherein a direction that the positioning groove extends and a direction that the bending scheduled portion extends are parallel to each other, and the positioning groove and the bending scheduled portion are not located on a same line.

4. The method of manufacturing a coil component according to claim 1, wherein the temporary fixing includes preparing a pressing segment where the pressing segment and the connecting portion sandwich the wire positioned by being fitted in the positioning groove, and fixing the wire by pressing the wire toward the connecting portion by the pressing segment.

5. The method of manufacturing a coil component according to claim 1, wherein the positioning groove is formed in a V shape in cross section.

6. The method of manufacturing a coil component according to claim 1, wherein the positioning groove is located within a region where welding is scheduled in the welding.

* * * * *